United States Patent [19]

Sturtevant

[11] 4,116,508

[45] Sep. 26, 1978

[54] PORTABLE BATHROOM CABINET

[76] Inventor: Howard Sturtevant, 234 Eastwood Ave., Providence, R.I. 02919

[21] Appl. No.: 724,344

[22] Filed: Sep. 17, 1976

[51] Int. Cl.[2] ..... A46B 17/00; A47F 5/08

[52] U.S. Cl. ..... 312/245; 312/43; 312/45; 312/206

[58] Field of Search ..... 312/245, 206, 207, 43, 312/45, 72, 254; 211/DIG. 1

[56] References Cited

U.S. PATENT DOCUMENTS

| | | | |
|---|---|---|---|
| 946,377 | 1/1910 | Leonard | 312/245 |
| 1,184,424 | 5/1916 | Cooley | 312/43 |
| 1,714,469 | 5/1929 | Hoffman | 312/45 |
| 2,323,841 | 7/1943 | Pape et al. | 312/43 |
| 2,538,966 | 1/1951 | Flannery | 312/245 |
| 2,717,819 | 9/1955 | Kirkwood, Jr. | 312/245 |
| 3,138,414 | 6/1964 | La Pollo | 312/245 |
| 3,427,086 | 2/1969 | Acton | 312/245 |
| 3,605,160 | 9/1971 | Maurer | 312/206 |
| 3,782,799 | 1/1974 | Hansen | 211/DIG. 1 |
| 3,783,364 | 1/1974 | Gallanis et al. | 312/206 |

*Primary Examiner*—Kenneth Downey
*Assistant Examiner*—Victor N. Sakran
*Attorney, Agent, or Firm*—Max Schwartz

[57] ABSTRACT

A generally rectangular cabinet having a pair of outwardly swinging doors. The center interior is designed to form a paper cup dispenser, the cups exiting at the center bottom. With proper shelving, hooks and clips the interior will hold toothbrushes, toothpaste, razors, lotions, and any other desired bathroom supplies. The interior of the doors can be supplied with hooks for suspending the toothbrushes leaving the rest of the cabinet for other items. The outside top can be mounted with clips for holding combs in a readily available position. The entire cabinet is compact, light and portable. A stand is provided which can be permanently positioned in the bathroom. The stand comprises a horizontal platform portion and a rear vertical wall portion. The cabinet fits onto the platform and against the rear wall. Suitable hooks are provided for releasably locking the cabinet to the stand. This allows the cabinet to be used in a fixed place at home, but permits its removal for travel.

5 Claims, 7 Drawing Figures

FIG. 1
FIG. 2
FIG. 3
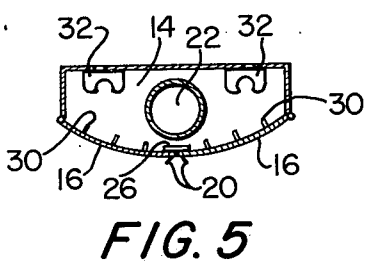
FIG. 5
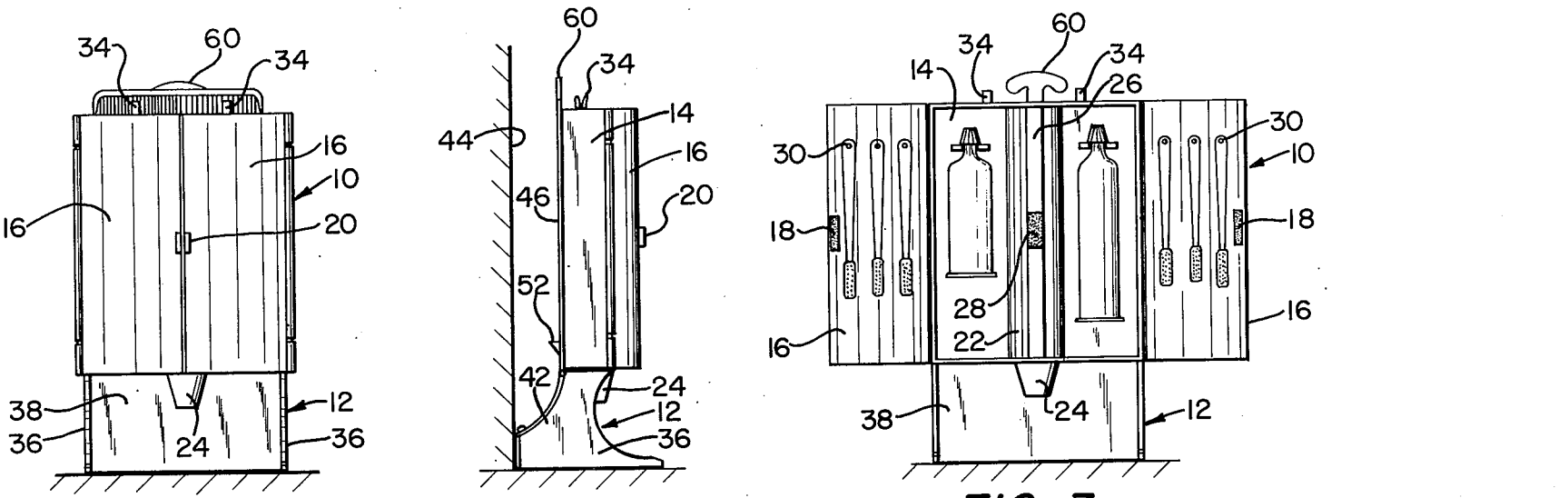
FIG. 4
FIG. 6
FIG. 7

PORTABLE BATHROOM CABINET

SUMMARY OF THE INVENTION

A compact portable bathroom cabinet which can be packed in a travel bag. A permanent base is placed in the home bathroom. The base has a horizontal platform portion and a rear vertical wall portion. The portable cabinet, when not traveling, is placed on the base and releasably attached to the rear wall, the ensemble forming a complete home bathroom cabinet. The portable portion has a pair of outwardly swinging doors and a central tube which forms a paper cup dispenser. Suitable clips, hooks and shelves are designed to hold the conventional bathroom supplies, with the toothbrushes hung on the inner walls of the cabinet.

DESCRIPTION OF THE DRAWINGS

In the drawings:

FIG. 1 is a front elevation of the portable cabinet of the present invention on its permanent stand;

FIG. 2 is a side elevation of the device shown in FIG. 1;

FIG. 3 is a view similar to FIG. 1 with the doors in open position;

FIG. 4 is a view similar to FIG. 2 showing the removal of the cabinet from the stand;

FIG. 5 is a section taken on line 5—5 on FIG. 4;

FIG. 6 is a rear view of the device as shown in FIG. 1, the cabinet being positioned on the stand; and FIG. 7 is a view similar to FIG. 2 showing an alternative form of stand for the portable cabinet.

DESCRIPTION OF THE INVENTION

The present invention is designed to provide a compact portable bathroom cabinet which can be set on a base and used at home when not traveling. Referring more in detail to the drawings, the device comprises a cabinet 10 and a base 12. The cabinet comprises a generally rectangular cabinet portion 14 which can be of any suitable material, such as plastic. The front is provided with a pair of outwardly swinging doors 16 having magnetic latches 18. Suitable manually engagable members 20 may be provided for opening and closing the cabinet.

The center of the cabinet portion 14 is provided with a vertical tube 22 which forms a dispenser for the paper cups 24. A vertical strip 26 is mounted at the front center of the cabinet portion 14, FIGS. 3 and 5, the inner edges of the doors 16 closing against this strip 26. The complementary metal magnet lock member 28 is mounted at the front of this strip, FIG. 3.

It is contemplated that the cabinet 10 be compact but roomy enough to hold all the necessary bathroom supplies. The inner walls of the doors 16 may be provided with hooks 30 for suspending a plurality of toothbrushes as shown in FIG. 3. On each side of the central tube 22, the rear wall may have suitable clips 32 for holding toothpase, shaving cream, or any other type of grooming tube. Intermediate shelves can also be provided, if desired, to hold other jars and bottles. If desired, the top can be provided with clips 34 for holding one or more combs in a convenient and readily available position.

The above described cabinet is portable and can easily be placed in a travel valise or trunk. The shelves can hold electric razors or other similar devices. However, when the user is at home, the cabinet is designed to provide a permanent home cabinet on its own base 12.

As shown in FIGS. 1 to 6 inclusive, I provide a base 12 having spaced vertical side walls 36, a transverse vertical supporting wall 38 extending between the walls 36, and a horizontal platform 40 on top of the walls 36 and 38. The front and rear edges of the side walls 36 are curved to provide forwardly and rearwardly extending portions, the rearwardly extending portions 42 serving to space the base 10 from the wall 44, FIG. 2.

Extending upwardly from the rear edge of the platform 40, is a vertical wall 46. The wall 46 is provided with suitable hooks 48, FIG. 4, at the front face thereof. At the rear, the wall 46 may be provided with hooks for hanging brushes 50, a trough 52 for holding nail files 54, and the rear of the base 12 may have a door 56 for providing a compartment for nail polish and similar supplies.

Viewing FIG. 4, the portable cabinet portion 10 can be placed on the platform 40, the rear wall of the cabinet portion being provided with slots or openings (not shown) for engagement with the hooks 48 on the vertical wall 46. Thus, with the cabinet 10 mounted on the base 12, a conventional bathroom cabinet is formed. However, for traveling, the cabinet 10 can be easily lifted from the base 12 as shown in FIG. 4 to provide a travel bathroom cabinet. It should be noted that the platform 40 is provided with suitable recess cutout at the front edge for the removal of the paper cups 24 at the bottom of the cabinet.

If it is desired to position the cabinet 10 flush with the wall 44, the base 58, FIG. 7, may be used. This base 58 has no rearwardly extended portion so that it sits against the wall and allows the vertical wall 46 to be flat against the wall 44. In this form, there can be no base compartment door and the brushes cannot be hung at the rear. In either form, the rear wall 46 may be provided with a handle 60 at the upper edge for easy handling.

I have thus provided a simple, compact, and readily portable bathroom cabinet designed to hold the usual bathroom supplies, toothbrushes, toothpaste, shaving cream, etc. While designed for a portable cabinet, a base is also provided for receiving the cabinet for a home installation when not traveling. Other advantages of the present invention will be readily apparent to a person skilled in the art.

I claim:

1. A portable bathroom cabinet for traveling, comprising a generally rectangular cabinet having an open front, a pair of outwardly swinging doors mounted at the front, a tubular paper cup reservoir and dispenser mounted vertically in the center of said cabinet, means in said cabinet for holding the bathroom supplies, and a base for mounting said cabinet in a bathroom when said cabinet is not being used as a portable traveling cabinet, whereing said base comprises a base portion having a horizontal platform and a vertical wall portion extending upwardly from the rear edge of said platform, said vertical wall is spaced from the bathroom wall, said vertical wall having hooks on the rear thereof forholding brushes, the rear of said base is provided with a door fro forming a compartment for grooming accessories.

2. A portable cabinet as in claim 1, wherein said holding means includes hooks on the inner surfaces of said doors for hanging toothbrushes and clips on the inner wall of said cabinet for holding toothpase or other tube dispensers.

3. A portable cabinet as in claim 1, wherein means are provided for releasably locking said cabinet to said base.

4. A portable cabinet as in claim 1, wherein said vertical wall is provided with hooks whereby said cabinet is releasably locked to said base when said cabinet is placed on said platform.

5. A portable cabinet as in claim 2, wherein means are provided for releasably locking said cabinet to said base.

* * * * *